US006318472B1

(12) United States Patent
Rogers et al.

(10) Patent No.: US 6,318,472 B1
(45) Date of Patent: Nov. 20, 2001

(54) HYDRAULIC SET LINER HANGER SETTING MECHANISM AND METHOD

(75) Inventors: Henry E. Rogers; Charles A. Butterfield, Jr.; David D. Szarka, all of Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/322,427

(22) Filed: May 28, 1999

(51) Int. Cl.[7] ..... E21B 23/01; E21B 43/10
(52) U.S. Cl. ..... 166/382; 166/208; 166/212
(58) Field of Search ..... 166/120, 208, 166/212, 317, 382

(56) References Cited

U.S. PATENT DOCUMENTS

| | | | | |
|---|---|---|---|---|
| 4,190,112 | | 2/1980 | Davis | 166/291 |
| 4,493,374 | * | 1/1985 | Magee, Jr. | 166/382 |
| 4,583,593 | | 4/1986 | Zunkel et al. | 166/382 |
| 4,679,624 | * | 7/1987 | Harris et al. | 166/120 |
| 4,823,881 | * | 4/1989 | Streich | 166/382 |
| 4,828,037 | * | 5/1989 | Lindsey et al. | 166/382 |
| 5,318,131 | * | 6/1994 | Baker | 166/382 |
| 5,413,172 | | 5/1995 | Laurel | 166/153 |
| 5,499,681 | | 3/1996 | White et al. | 166/382 |
| 5,553,672 | * | 9/1996 | Smith, Jr. et al. | 166/382 |
| 5,641,021 | | 6/1997 | Murray et al. | 166/291 |
| 5,722,491 | | 3/1998 | Sullaway et al. | 166/291 |
| 5,884,702 | * | 3/1999 | Yokley et al. | 166/290 |

OTHER PUBLICATIONS

Two pages from TIW catalog (undated but admitted to be prior art).

* cited by examiner

*Primary Examiner*—David Bagnell
*Assistant Examiner*—Jennifer Dougherty
(74) *Attorney, Agent, or Firm*—Craig W. Roddy; Anthony L. Rahhal

(57) ABSTRACT

An liner hanger setting mechanism is provided. The setting mechanism of the present invention is basically comprised of a tubular pump down plug receptacle having a plug seat defined therein. A cylindrical pump down setting plug having a central flow passage and a rupturable member disposed therein to prevent flow therethrough is dropped into a work string and the tubular plug receptacle. The pump down setting plug will engage the plug seat and pressure can be increased to the setting pressure required to set a hydraulically actuated liner hanger. The pressure can then be further increased to the rupture pressure of the rupturable member to provide for full bore flow through the pump down setting plug.

23 Claims, 7 Drawing Sheets

HYDRAULIC SET LINER HANGER SETTING MECHANISM AND METHOD

BACKGROUND OF THE INVENTION

This invention relates to setting mechanisms for liner hangers and more particularly to a setting mechanism which provides for full bore fluid flow prior to and after the liner hanger has been set to engage casing in the wellbore and suspend the liner therefrom.

In the construction of oil and gas wells, a wellbore is drilled into one or more subterranean formations or zones containing oil and/or gas to be produced. In most instances, after the wellbore is drilled, the drill string is removed and a casing string is run into the wellbore. During casing running operations, the casing must be kept filled with fluid to prevent excessive fluid pressure differentials across the casing string and to prevent blowouts. One manner of adding fluid to a casing string is by providing well casing fill apparatus which can be utilized at or near the bottom end of the casing string to allow well fluid in the wellbore to enter the interior of the casing while it is being run. One particularly useful casing fill apparatus is disclosed in U.S. Pat. No. 5,641,021 to Murray et al., issued Jun. 24, 1997, assigned to the assignee of the present invention, the details of which are incorporated herein by reference.

A liner, which simply refers to casing having a smaller outer diameter than the inner diameter of a casing that has already been cemented into a portion of the wellbore, is used for a number of reasons, and typically extends from the bottom end of the existing casing downward into the uncased portion of the wellbore. The liner will typically include float equipment such as float shoes and float collars at or near the lower end thereof. The liner is lowered on a work string having a smaller diameter than the liner. The work string may have holes or ports defined therethrough so that fluid entering the liner through casing fill apparatus like that set forth above can pass therethrough. Such an arrangement alleviates surge pressure that may occur when the liner is lowered into the wellbore and prevents, or at least reduces the possibility of damage to a formation from pressure caused by lowering the liner into the wellbore. Such an arrangement is shown in U.S. patent application Ser. No. 09/106,484, filed Jun. 29, 1998, which is assigned to the assignee of the present application, and the details of which are incorporated herein by reference.

The liner assembly may also include pump down wiper plugs which separate, or serve as the interface between, the wet cement from the fluid it is displacing, or the fluid which is being used to pump the wet cement to the desired level. A wiper plug also wipes off the inner surface of the pipe string as it passes, and prevents back flow while the cement is setting up. Although oftentimes only one wiper plug is used, it is preferred to use a bottom and a top wiper plug. Such an arrangement is shown in U.S. Pat. No. 5,413,172, issued May 9, 1995, to Laurel, the details of which are incorporated herein by reference.

The work string includes a running tool, which is known in the art, that attaches to the liner and is utilized to lower the liner into the wellbore. A liner hanger is connected to and disposed about the running tool and work string. There are a number of types of liner hangers, including liner hangers that are hydraulically set or actuated. Hydraulically set liner hangers typically include slips that expand outwardly to engage casing and suspend a liner in a wellbore. Such hydraulically set, or hydraulically actuated liner hangers are well known in the art.

Hydraulic set liners are actuated by increasing the pressure inside the work string to a desired setting pressure which causes slips or other anchoring mechanism to expand into and engage the casing. One prior art setting mechanism simply comprises a setting sleeve with a ball seat positioned in the liner above the float equipment and below the pump down wiper plugs. In order to set the liner hanger, a ball is simply displaced downward through the work string and the liner until it engages the ball seat. Pressure is increased to the setting pressure at which time the liner hanger is actuated to engage the casing and suspend the liner from the casing. The pressure can then be increased which will cause the ball, and sometimes the setting sleeve, to be displaced downward through the float equipment at the bottom of the liner. Although such an arrangement works well to set the liner, there are disadvantages. Float equipment is limited to flapper-type valves which historically are subject to failure by erosion of the valve during circulation and cement placement. Further, the minimum inner diameter through which the liner and work string must fill while running in the hole is the small inner diameter of the setting sleeve. Such a restriction can create high hydraulic forces on open formations which may exceed their fracture gradient, cause potential lost circulation problems, have blowout potential, and may damage productive formations. The restriction also causes the liner to be run more slowly than is desired, especially in circumstances involving close clearance between the liner/liner hanger and the parent casing in which the hanger is to be set. Most liner cementing plug systems which utilize such a setting sleeve are limited to a top plug only for hydraulic set systems. Enhanced fill mechanisms like that described in U.S. Pat. No. 5,641,021 issued Jun. 24, 1997 to Sullaway et al., the details of which are incorporated herein by reference cannot be used because of incompatibilities between the enhanced fill mechanism and the setting sleeve. Finally, such a setting mechanism must be activated prior to conducting cementing operations.

Another manner of setting hydraulically actuated liner is to provide a seat in the work string below the liner hanger and above any pump down wiper plugs. A solid plug or ball may be dropped into the seat and pressure increased to the setting pressure. One difficulty with such an arrangement, however, is that the liner hanger can be set only after cementing operations have been performed, since once the plug is dropped into the work string there is no flow passage through which cement can be displaced to set the liner in the wellbore.

Thus, there is a need for a setting mechanism which can be utilized to set a hydraulically set liner either before or after cementing operations have been conducted. Furthermore, there is a need for a setting mechanism which can be utilized to set such a liner and which will allow the use of enhanced casing fill-up apparatus and that will allow the use of two plug cementing plug sets. There is also a need for a setting mechanism which will allow for high circulation rates through the liner without damaging the formation.

SUMMARY OF THE INVENTION

The present invention provides a setting mechanism for a hydraulically set liner hanger which meets the needs described above and overcomes the shortcomings of the prior art. The setting mechanism may also be referred to as a hanger activating tool or a setting apparatus. The setting apparatus comprises a means for setting a liner hanger to engage casing and suspend the liner therefrom at a desired time, which may be either before or after cement has been displaced through the work string and the liner to cement the liner in the wellbore. The present invention may thus comprise a plug receptacle which is a generally tubular member connected in the work string. The plug receptacle has first and second inner diameters defining a plug seat which is adapted to engage a pump down setting plug. The tubular member is adapted to be connected in the work string below the liner hanger and above pump down wiper plugs, which preferably includes a plug set comprising a top and bottom wiper plug.

The pump down setting plug generally comprises a tubular housing having an upper and a lower end defining a central flow passage therethrough. The lower end of the tubular housing will engage the plug seat. A rupturable member is disposed in the tubular housing to prevent flow therethrough. Once the pump down setting plug is lowered into the work string and engages the pump down setting plug seat, pressure can be increased to hydraulically actuate the liner hanger so that the liner hanger will engage the casing and suspend the liner therein. Thus, the rupture pressure of the rupturable member is higher than the setting pressure at which the liner hanger will set against the casing. The pump down setting plug therefore comprises a means for obstructing fluid flow, and thereby increasing pressure in the work string to at least the setting pressure required to set the liner hanger.

The central opening of the pump down setting plug preferably defines an inner diameter that is equal to or slightly greater than the second diameter of the pump down setting plug receptacle such that full bore flow is established once the rupturable member bursts. Thus, full bore fluid flow is allowed both prior to and after the pump down setting plug is dropped into the work string. The liner can therefore be lowered at a relatively rapid rate through the use of enhanced casing fill apparatus without applying pressure to and damaging any open formations. Furthermore, the pump down setting plug may be dropped prior to or after the displacement of cement. Thus, the invention of the present application provides distinct advantages over the prior art and meets the needs set forth above. It is therefore an object of the present invention to provide for a liner hanger setting apparatus that will allow for full bore fluid flow while the liner is lowered into the wellbore and after the liner hanger has been set. It is a further object of the invention to provide a liner hanger setting apparatus that is compatible with enhanced casing fill apparatus. It is, therefore, a general object of the present invention to provide an improved setting mechanism for hydraulically set liner hangers. Other objects, features and advantages of the present invention will be readily apparent to those skilled in the art upon a reading of the description of the preferred embodiments which follows when taken in conjunction with the accompanying drawings.

BRIEF DESCRIPTION OF THE DRAWINGS

FIG. 6 is a schematic of a work string including a setting mechanism of the present invention lowered into a wellbore.

DESCRIPTION OF THE PREFERRED EMBODIMENT

Figure 1A:
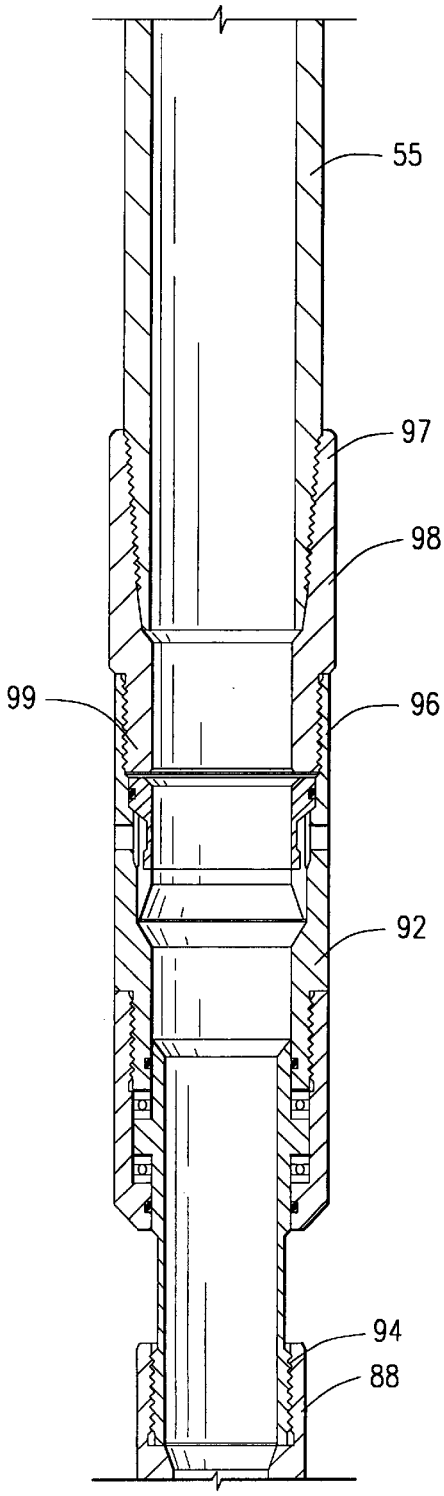
FIGS. 1A and 1B show a section view of the setting mechanism of the present invention.

Referring now to the figures and more specifically to FIG. 6, a wellbore 10 having a cased portion 15 and an uncased portion 20 is shown therein. Cased portion 15 has a casing 25 disposed therein defining a casing bore 30. A liner 35 is shown disposed in wellbore 10. Liner 35 has an upper end 36 and a lower end 37. An annulus 38 is defined by and between liner 35 and casing 25 at the upper end 36 of liner 35. Liner 35 is lowered into wellbore 10 on a work string 40 which may include a drill string 45, and a liner hanger and running tool 50 and 52 as schematically shown in FIG. 6. It will be understood that liner hanger 50 may be any type of hydraulically set liner hanger, and the running tool may be of any type known in the art compatible with hydraulically set liner hangers. A stinger 55 may extend downward from running tool 52.

A fill apparatus 60, which may be like that shown in U.S. Pat. No. 5,641,021 is indicated by the numeral 60. The liner may also have a float collar and a float shoe disposed therein as indicated by the numerals 65 and 70 respectively. Float valve 65 and float shoe 70 are preferably a poppet-type float valve and shoe as are known in the art.

The setting mechanism of the present invention is designated by the numeral 75 and is more clearly seen in FIGS. 1–5. Setting mechanism 75 may be attached to stinger 55, and may thus comprise a part of work string 40. Setting mechanism 75, which may also be referred to as a hanger activating tool, or liner hanger setting apparatus, comprises a pump down setting plug receptacle 80. Pump down plug receptacle 80 is preferably a generally tubular member, having a central opening 82 comprising a bore 84. A pump down setting plug seat 86 is defined in opening 82. Plug seat 86 is an upward facing seat defined by and between a first inner diameter 85, which is the diameter of bore 84, and a second inner diameter 87 defined by central opening 82. Pump down plug receptacle 80 has an upper end 88 and a lower end 90, and in the embodiment shown, upper end 88 has threads therein adapted to be connected to a swivel equalizer valve 92 of a type known in the art.

Equalizer valve 92 has a lower end 94 connected to pump down plug receptacle 80 and an upper end 96 connected to an adapter 98. Adapter 98 has an upper end 97 and a lower end 99. Upper end 97 is adapted to be threadedly connected to stinger 55. Adapter 98 may also be attached to a drill pipe, or other string of pipe. Although pump down plug receptacle 80 is shown in the preferred embodiment as having swivel equalizer valve 92 connected thereto, adapter 98 may be connected at its lower end 99 directly to the pump down plug receptacle, and at its upper end 97 to stinger 55, or other work string or string of pipe.

Lower end 90 of pump down plug receptacle 80 is attached to a subsurface release plug assembly 100. At the upper end of subsurface release plug assembly 100 is a collet retainer 101 having a chamfered shoulder 102. An upper end 103 of a collet 104 is disposed in collet retainer 100 such that head portions 106 of a plurality of collet fingers 108 engage shoulder 102 of collet retainer 101.

A releasing sleeve 110 is slidably disposed in collet 104. It will be seen that in the original position of FIGS. 1 and 3, releasing sleeve 110 keeps head portions 106 of collet finger 108 engaged with shoulder 102 in collet retainer 100.

Figure 1B:
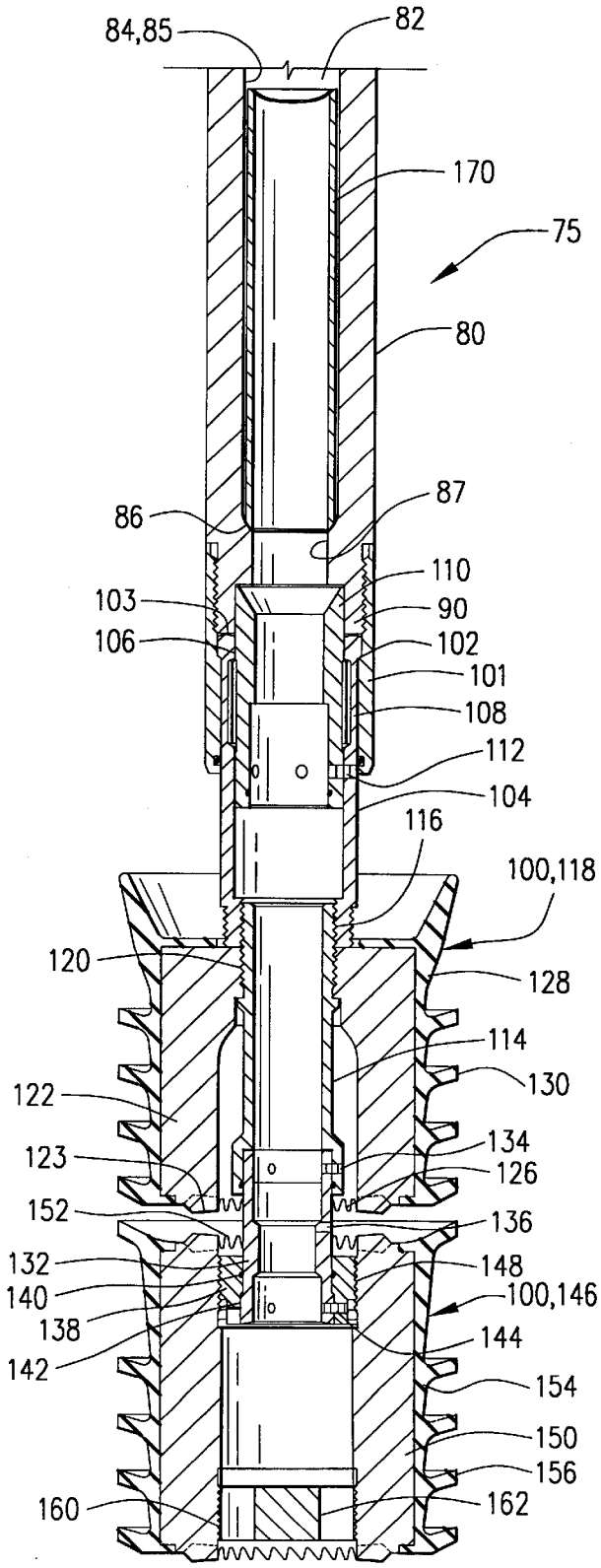
Figure 2:
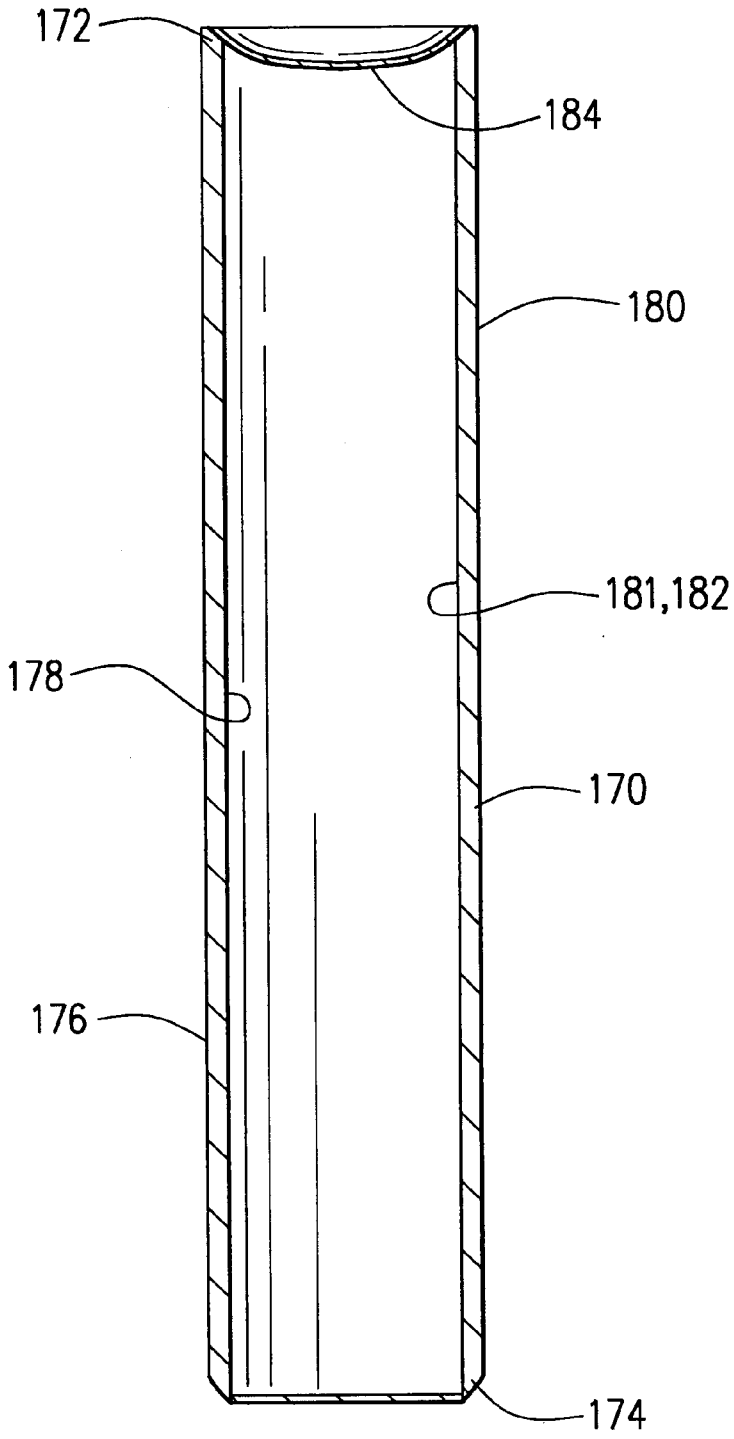
FIG. 2 shows a cross section of the pump down setting plug of the present invention.
Figure 3:
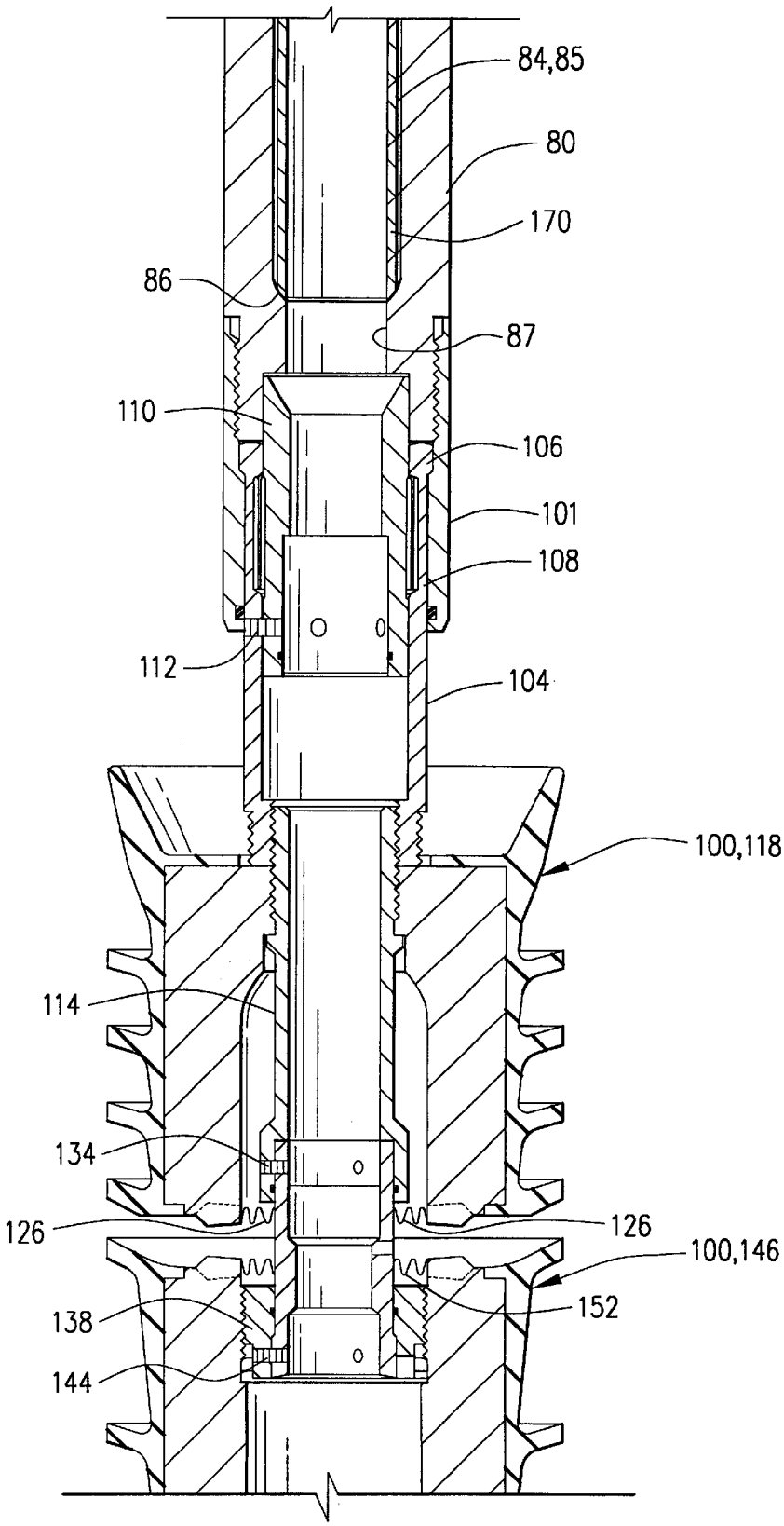
FIG. 3 is a section view of the setting mechanism after the pump down setting plug has engaged the plug seat.

A shear means 112, such as a shear pin, is engaged with collet 104 and releasing sleeve 110, thus releasably holding the releasing sleeve in the original position shown in FIG. 1. The lower end of collet 104 is attached to a collet connector 114 at threaded connection 116.

A first or upper wiper plug 118, also referred to as a top wiper plug 118, is attached to collet connector 114 at threaded connection 120. Collet connector 114 extends longitudinally through upper plug means 118.

Upper wiper plug 118 has a body or insert 122 with an upper inwardly directed portion which forms threaded connection 120 with collet connector 114. Insert 122 is preferably made of a high-strength plastic material, such as described in U.S. Pat. No. 5,413,172, incorporated herein by reference for the first and second embodiments. A plurality of integrally formed teeth 126 may be located on the lower end 123 of insert 122.

Insert 122 is substantially surrounded by a jacket 128 bonded to the insert and preferably made of elastomeric material. Jacket 128 includes a plurality of wipers 130 adapted for sealingly engaging the inside surface of well casing 16.

The lower end of collet connector 114 is attached to a vent sleeve 132 by a shear means 134, such as a shear pin. Vent sleeve 132 defines a vent means, such as a transverse vent opening 136 therethrough. Slidably disposed around an enlarged lower end of vent sleeve 132 is a bushing 138. Seal means 140 provides sealing engagement between bushing 138 and vent sleeve 132. The lower end of bushing 138 is adjacent an upwardly facing shoulder 142 on vent sleeve 132. Shear means 144, such as a shear pin, provides releasable attachment between bushing 138 and vent sleeve 132.

A second or lower wiper plug 146 is connected to bushing 138 at threaded connection 148. Lower wiper plug 146 includes a body or insert 150 made of a high-strength plastic material, such as described in U.S. Pat. No. 5,413,172, incorporated herein by reference. A plurality of teeth 152 may be integrally molded on the upper end of insert 150. Teeth 152 are adapted for meshing engagement with teeth 126 on the lower end of insert 122 of upper plug means 118.

Substantially surrounding and bonded to insert 150 is a jacket 154, preferably made of elastomeric material. Jacket 154 has a plurality of flexible wipers 156 which are adapted for sealing engagement with the inside of liner 35.

A catcher plate 158 is disposed in the lower inner portion of insert 150 and attached thereto at threaded connection 160. Catcher plate 158 could also be integrally molded as part of insert 150 with no threaded connection being necessary. Catcher plate 158 defines a plurality of openings 162 therethrough which assures fluid flow therethrough without allowing any of the mechanical components of the apparatus to pass thereby.

Setting mechanism 75 of the present invention also includes a pump down setting plug 170. Pump down setting plug 170 is preferably a generally cylindrical member having an upper end 172, a lower end 174, an outer surface 176 and an inner surface 178. Outer surface 176 has a diameter 180 which is less than diameter 85 of central opening 82 such that pump down setting plug 170 is received in pump down plug receptacle 80. Lower end 174 engages plug seat 86 to prevent pump down plug 170 from passing therethrough. Inner surface 178 defines a bore 181 having a diameter 182. Bore 181 comprises a flow passageway 183. Pump down plug 170 further includes a rupturable member 184 which is preferably a rupture disk. Rupture disk 184 prevents flow through bore 181 and thus through work string 40 until a predetermined rupture pressure, also referred to as a burst pressure, is reached in the work string. When the rupture pressure is reached, the member 184 will rupture, and full bore, unrestricted fluid flow is allowed through setting plug 170.

Figure 7:
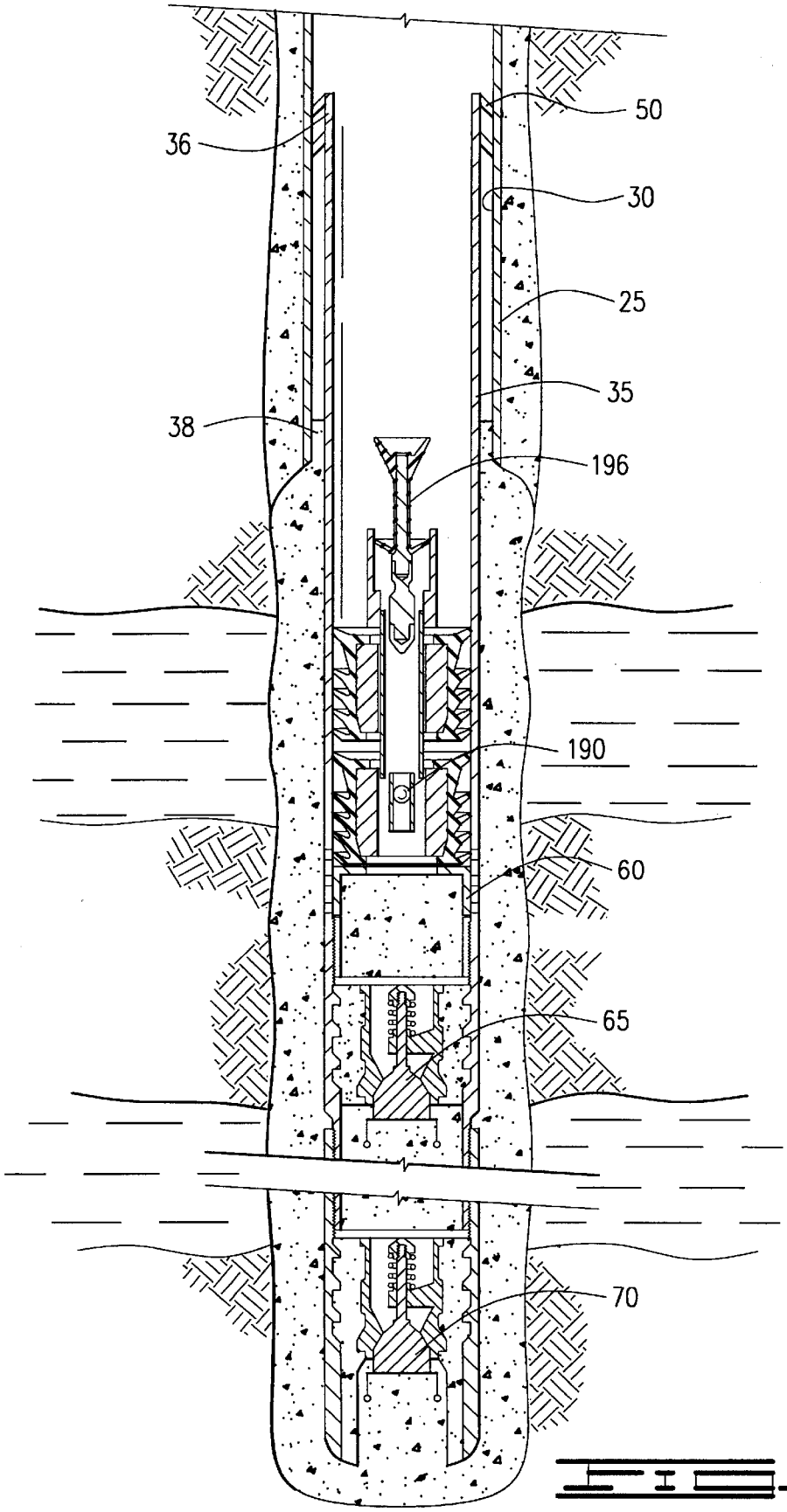
FIG. 7 schematically shows a wellbore after cement has been displaced therein to attach the liner to the existing casing.

The operation of setting mechanism 75 may be described initially with reference to the schematic shown in FIGS. 6 and 7. As shown in FIG. 6, liner 35 may be lowered to the desired depth on work string 40 including setting mechanism 75 of the present invention. Once liner 35 has reached the desired depth, pump down setting plug 170 may be dropped from the surface and allowed to free fall until it engages seat 86 in pump down plug receptacle 80. If desired, the fall of pump down setting plug 170 may be assisted by slowly circulating the hole by pumping down the work string. Once pump down plug 170 engages seat 86, continued displacement of fluid into the work string will cause pressure to increase to the setting pressure of the liner hanger. The rupture pressure required to rupture, or burst rupturable member 184 and establish flow through pump down plug 170 is greater than the setting pressure required to actuate the liner hanger used to engage casing 25 and suspend liner 35 therefrom.

There are a number of different types of known hydraulically set liner hangers and any of such hangers may be utilized with the setting mechanism of the present invention. It is only necessary that the pressure at which the rupture disk fails is higher than the setting pressure of the liner hanger. For example, in a liner hanger which utilizes a setting piston to activate slips on the liner hanger to engage the casing and suspend liner 35 in casing 25, the pressure required to move the setting piston and expand the slips will be less than the pressure which will cause the rupturable member 184 to fail. Once slips on liner hanger 50 are activated to suspend liner 35 inside casing 25, fluid is continually displaced in work string 40 until rupture disk 184 ruptures and flow is established through pump down plug 170.

Figure 4:
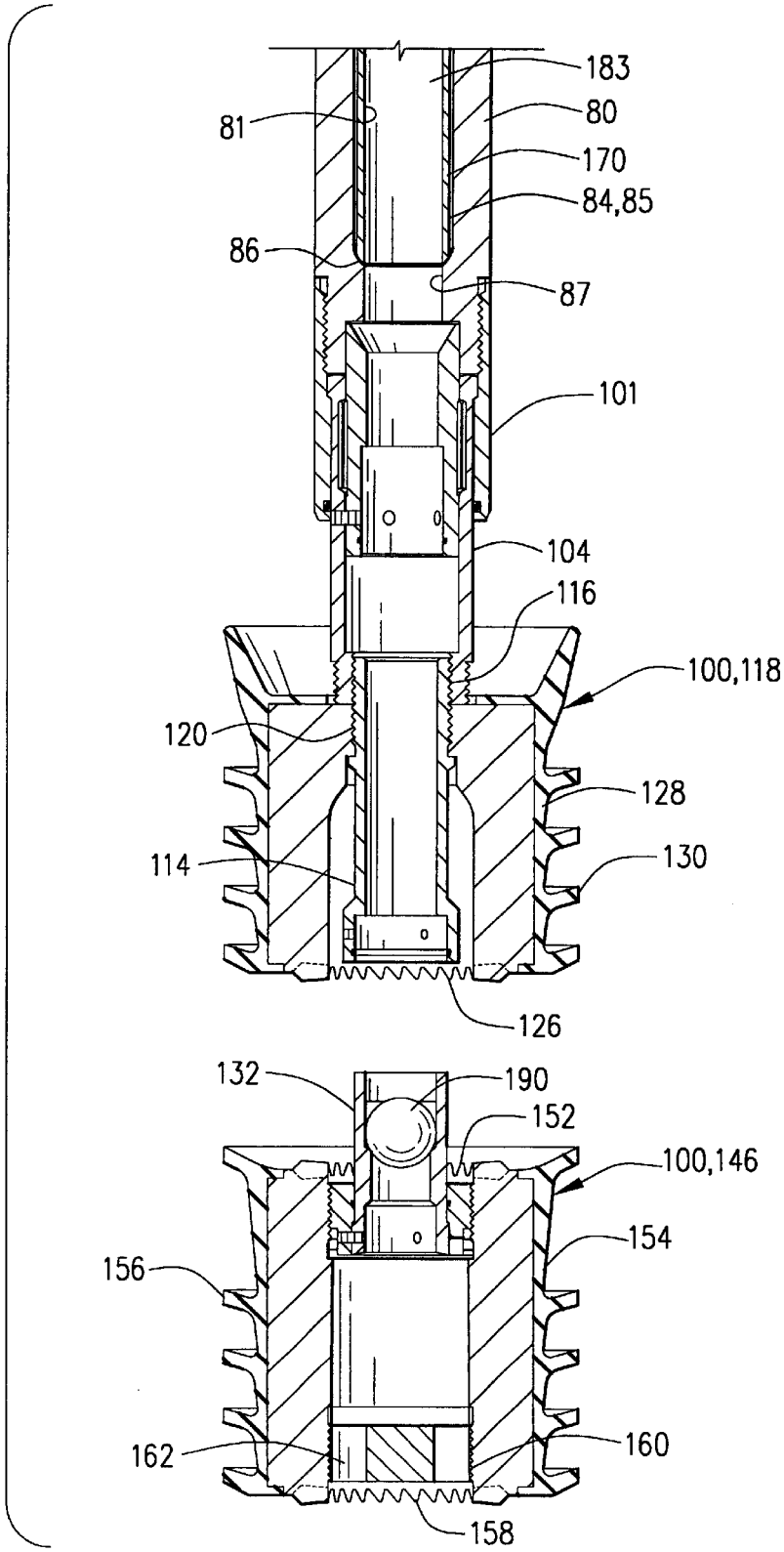
FIG. 4 shows a section view of the present invention after flow has been established through the pump down setting plug and a ball has been dropped to release a bottom subsurface release plug.
Figure 5:
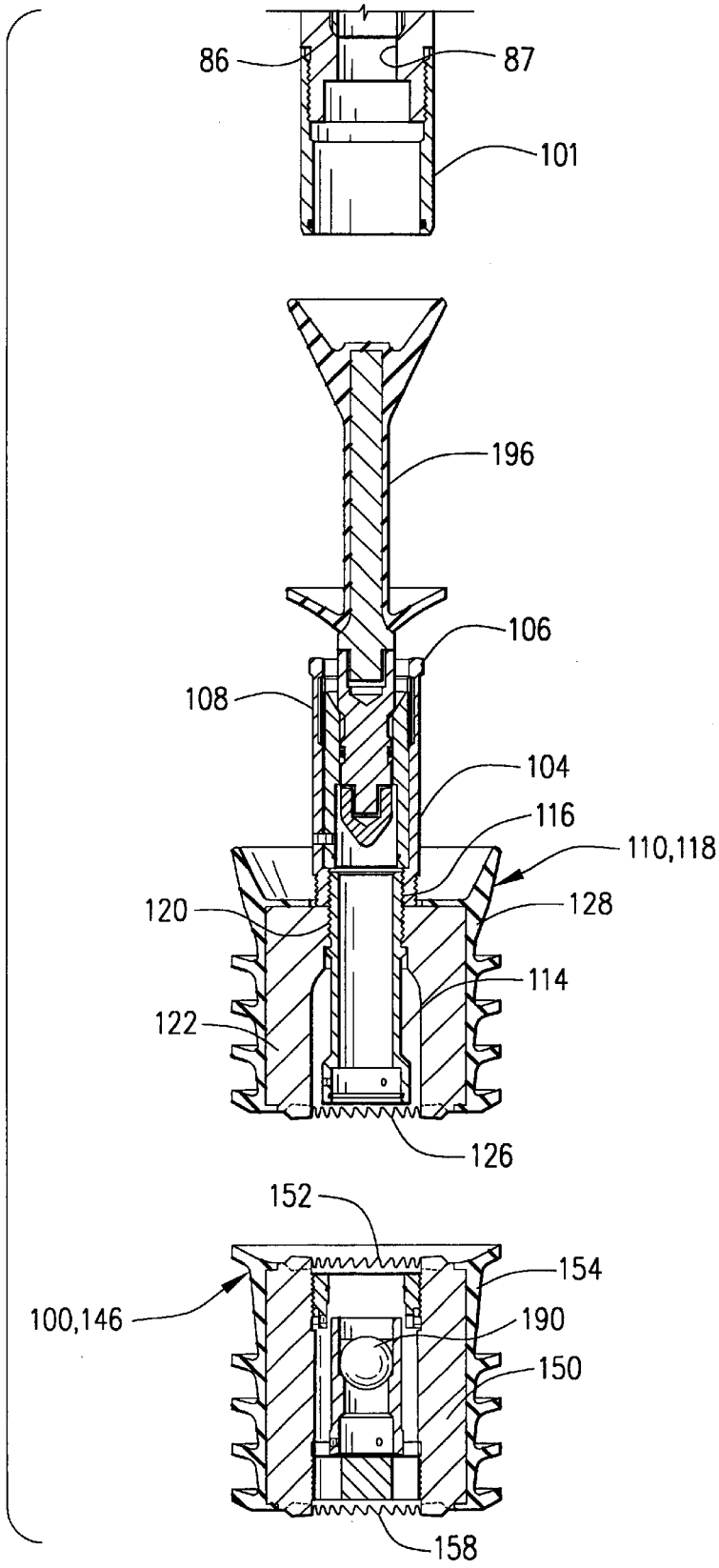
FIG. 5 shows a section view of a drill pipe dart engaging the top subsurface release plug.
Figure 3:
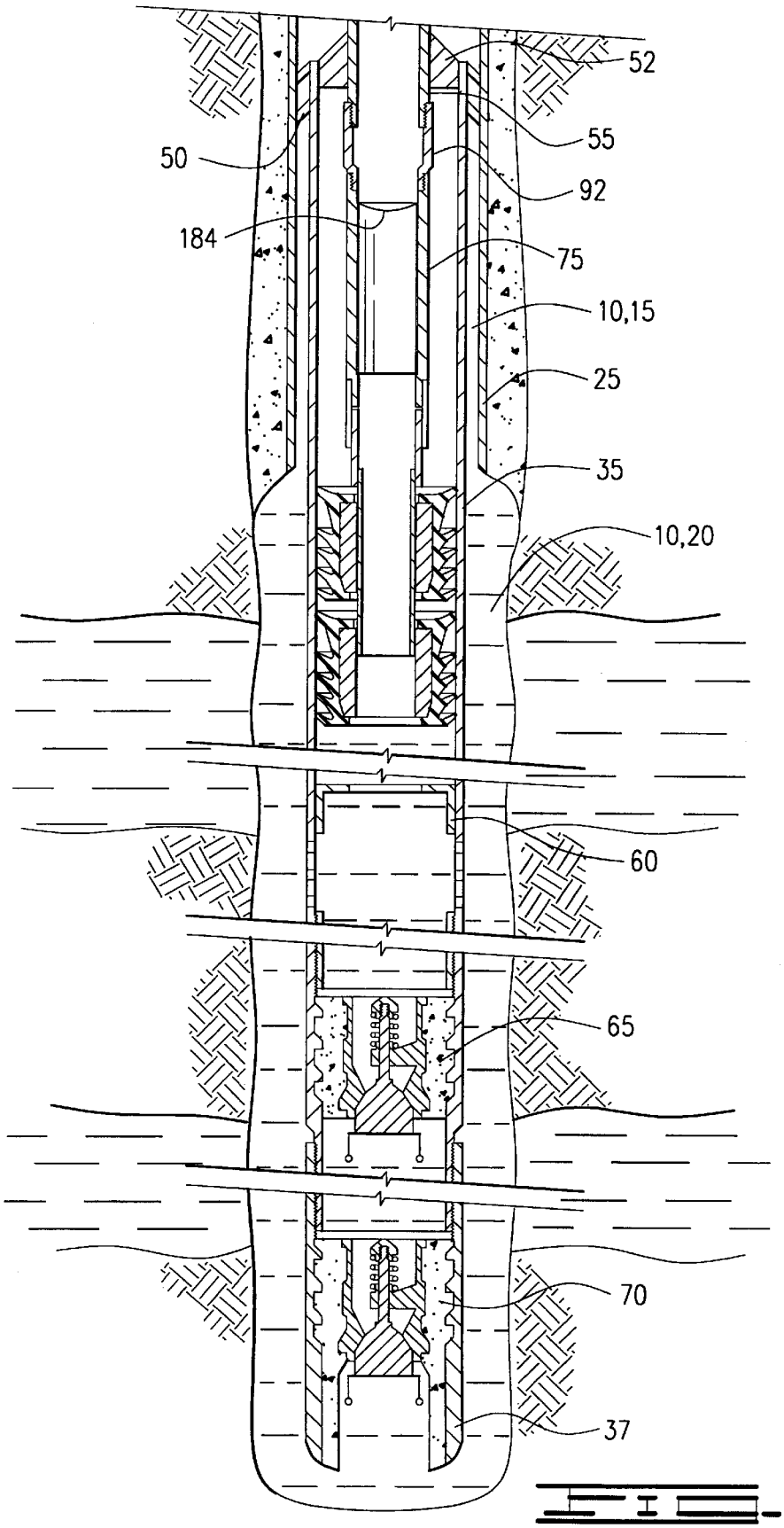

As is apparent from the drawings, full bore, unrestricted flow may be established through pump down setting plug 170, since there are no restrictions or obstructions to cause the flow to be impeded. Once the rupture disk is open, normal cementing operations can be performed. Referring to FIG. 4, a release ball 190 may be dropped through work string 40 until it engages vent sleeve 132. Pressure is increased until pins 134 shear releasing lower wiper plug which may be referred to as subsurface release plug 146. The subsurface release plug set described herein is described in more detail in U.S. Pat. No. 5,413,172.

Once plug 146 lands, pressure is increased to a predetermined pressure to shear pins 144, which allows vent sleeve 132 to fall to catcher plate 158, and thus provide an open fluid passageway. Cement will continue to be flowed through openings 162 in lower wiper plug 146 and will flow out the bottom of liner 35 through any float equipment utilized herein. Once a sufficient amount of cement has been displaced into the wellbore, a drill pipe dart 196 may be displaced through the work string until it engages releasing sleeve 110. As pressure is increased, shear means 112 shears so that releasing sleeve 110 moves downward, allowing collet heads 106 to move inward, thus releasing upper wiper plug 118. The drill pipe and running tool may then be removed.

The operation of the setting mechanism 75 of the present invention as described above includes dropping pump down setting plug 170 into receptacle 80 prior to displacing cement. As is obvious from the drawings and the description herein, however, pump down setting plug 170 may be released into work string 40 either before or after cement is displaced down the liner to cement the liner in place. Thus, ball 190 may be dropped to engage and release lower wiper plug 146, and cement may be flowed through liner 35 until the desired amount of cement is displaced prior to dropping pump down plug 170 into the plug receptacle 80. Dart 196 can then be dropped to engage and release upper wiper plug 118, and pump down plug 170 can be released into the work string. Thus, plug receptacle 80 and plug 170 comprise setting means for setting a liner hanger at a desired time, either before or after cement has been displaced down the work string to cement the liner in place. The setting means comprises means for obstructing flow, and thus increasing hydraulic pressure to a setting pressure, either before or after cementing operations are conducted. Such capability provides only one of the many advantages of the present invention over the prior art.

One prior art type of setting mechanisms typically includes a setting sleeve positioned in the liner above the float valves. Such a setting sleeve has a reduced inner diameter to receive a setting ball so that hydraulic pressure can be increased to set the liner hanger. The diameter must be reduced to such a degree that the ball received therein can be extruded through float valves therebelow. The disadvantages and distinctions associated with such setting sleeves have been previously set forth, and the most preferred cementing practices cannot be adhered to with such a setting sleeve due to the forced absence of a bottom cementing plug and restricted circulation rates due to the inner diameter restriction of the setting sleeve.

A second type of prior art setting mechanism comprises a seat positioned in a work string above subsea release plugs and a solid plug that engages the seat near the end of cementing operations. Such a setting mechanism can only be utilized after the cementing job since a solid plug must be utilized. Although there may be restricted flow around the solid plug, there is not enough of a flow passage to allow cementing operations to be conducted.

The present invention thus provides many distinct advantages of the prior art. Pump down setting plug receptacle 80 has no flow restrictions so that when the liner is lowered into the wellbore, it alleviates the problems of hydraulic forces on open formations. Liner 35 can be run more quickly than a liner which utilizes a setting sleeve to set a hydraulically actuated liner hanger, since enhanced fill mechanisms like that described in U.S. Pat. No. 5,641,021 can be utilized. Because there is no setting ball which would otherwise have to be capable of passing through all components of the work string, superior poppet valve floating equipment may also be used. The use of two plug liner cementing plug sets is also provided for. Furthermore, the liner hanger can be set either prior to cementing or after cementing since both pump down plug receptacle 80 and pump down plug 170 allow full bore, unrestricted fluid flow.

It can be seen, therefore, that the hydraulic set liner hanger setting mechanism and method of the present invention is well adapted to carry out the ends and advantages mentioned as well as those inherent therein. While the presently preferred embodiments of the invention have been shown for the purposes of this disclosure, numerous changes in the arrangement and construction of parts may be made by those skilled in the art. All such changes are encompassed within the scope and spirit of the appended claims.

What is claimed is:

1. A setting apparatus for setting a hydraulically activated liner hanger to suspend a liner lowered into a wellbore on a work string from casing disposed in said wellbore, said liner hanger being activated by an increase in hydraulic pressure to a predetermined setting pressure, the setting apparatus comprising:

a plug receptacle connected to said work string below said liner hanger and communicated therewith, said plug receptacle defining a central opening having a plug seat for engaging a pump down setting plug adapted to be circulated through said work string and into said plug receptacle, said pump down setting plug comprising:

a tubular housing having an upper end and a lower end and defining a central flow passage therethrough, wherein said lower end of said housing engages said plug seat; and a rupturable member disposed in said tubular housing to prevent flow therethrough and through said work string, said rupturable member having a rupture pressure higher than said setting pressure, so that hydraulic pressure in said work string may be increased to activate said liner hanger to engage said casing and suspend said liner in said wellbore prior to rupturing said rupturable member.

2. The setting apparatus of claim 1 further comprising:

a subsurface release plug releasably attached to a lower end of said plug receptacle.

3. The setting apparatus of claim 1, wherein said pump down setting plug may be displaced down said work string into said receptacle either prior to or after cement has been flowed through said work string to cement said liner in place in said wellbore.

4. The setting apparatus of claim 1 wherein said pump down setting plug is generally cylindrical, so that unrestricted full bore fluid flow through said pump down plug is established after said rupturable member ruptures.

5. The setting apparatus of claim 1 wherein said plug receptacle is a generally tubular member having a first inner diameter and a second inner diameter, said seat being defined between said first and second diameters.

6. The setting apparatus of claim 1 further comprising:

a subsurface release plug set connected to a lower end of said plug receptacle, said plug set comprising an upper wiper plug and a lower wiper plug.

7. A liner hanger setting apparatus for setting a hydraulically actuated liner hanger in a casing disposed in a wellbore to suspend a liner from said casing, said liner being run into said wellbore on a work string, said work string having a plug seat defined therein, said setting apparatus comprising:

a cylindrical setting plug adapted to engage said plug seat, said cylindrical setting plug defining a central flow passage and having a rupturable member disposed across said flow passage to prevent flow through said work string so that hydraulic pressure in said work string will increase to a setting pressure of said setting apparatus.

8. The apparatus of claim 7, further comprising:

a tubular member connected in said work string below said liner hanger, wherein said plug seat is defined in said tubular member.

9. The apparatus of claim 7, wherein said rupturable member will rupture at a pressure in excess of said setting pressure to establish full bore flow through said cylindrical setting plug.

10. A method for hanging a liner in a casing cemented in a wellbore comprising:

lowering said liner on a work string to a desired depth in said wellbore;

placing a rupturable member in said work string to obstruct flow therethrough and increase pressure in said work string to a setting pressure of a liner hanger disposed about said liner; and removing said rupturable member from said work string to establish flow therethrough.

11. The method of claim 10 further comprising:

releasing a bottom wiper plug into said liner;

circulating cement through said work string and liner to cement said liner in said wellbore; and releasing a top wiper plug into said liner.

12. The method of claim 10, wherein said removing step comprises increasing pressure in said work string to a rupture pressure of said rupturable member.

13. The method of claim 10 further comprising displacing cement through said work string and said liner prior to said placing step.

14. The method of claim 10 further comprising displacing cement through said work string and said liner after said removing step.

15. A method of increasing pressure in a work string disposed in a wellbore, the method comprising:

displacing a cylindrical member having upper and lower ends into said work string, said cylindrical member defining a flow passage therethrough, said flow passage having a rupturable member disposed therein to prevent flow through said flow passage and said work string; and displacing fluid into said work string above said rupturable member to increase pressure in said work string to a desired pressure.

16. The method of claim 15, further comprising:

rupturing said rupturable member after said desired pressure has been reached.

17. The method of claim 16, wherein said rupturing step comprises:

displacing fluid into said work string to increase said pressure to a rupture pressure of said rupturable member.

18. The method of claim 15, further comprising establishing unrestricted full bore fluid flow through said cylindrical member after said pressure has been increased to said desired pressure.

19. A method for hanging a liner in a casing cemented in a wellbore comprising:

lowering said liner on a work string to a desired depth in said wellbore;

placing a rupturable member in said work string to obstruct flow therethrough;

increasing pressure in said work string to a setting pressure of a liner hanger connected to said liner; and rupturing said rupturable member to establish flow through said work string.

20. The method of claim 19 wherein said rupturing step comprises increasing pressure in said work string to a rupture pressure of said rupturable member, said rupture pressure being a higher pressure than said setting pressure.

21. The method of claim 19 further comprising:

displacing a fluid through said work string and said liner prior to said placing step.

22. The method of claim 21 wherein said fluid comprises cement.

23. The method of claim 19 further comprising:

displacing cement through said work string and said liner after said rupturing step.

* * * * *